United States Patent [19]

Brattström et al.

[11] Patent Number: 4,481,886

[45] Date of Patent: Nov. 13, 1984

[54] HOLLOW CHARGE

[75] Inventors: Leif Brattström, Karlskoga, Sweden; Kjell Mattsson, San Leandro, Calif.; Bertil Arvidsson, Karlskoga, Sweden

[73] Assignee: Aktiebolaget Bofors, Bofors, Sweden

[21] Appl. No.: 458,100

[22] Filed: Jan. 14, 1983

[30] Foreign Application Priority Data

Jan. 15, 1982 [SE] Sweden ..... 8200194

[51] Int. Cl.[3] ..... F42B 1/02

[52] U.S. Cl. ..... 102/476; 102/306

[58] Field of Search ..... 102/306, 307, 476

[56] References Cited

U.S. PATENT DOCUMENTS

| | | | |
|---|---|---|---|
| 3,224,368 | 12/1965 | House | 102/306 |
| 3,976,010 | 8/1976 | Zernow | 102/476 |
| 4,338,713 | 7/1982 | Cristopher | 102/306 |
| 4,374,495 | 2/1983 | Thomanek | 102/476 |

FOREIGN PATENT DOCUMENTS

| | | | |
|---|---|---|---|
| 540824 | 9/1955 | Belgium | 102/476 |
| 1478008 | 4/1970 | Fed. Rep. of Germany . | |
| 883664 | 3/1958 | United Kingdom . | |
| 884104 | 6/1959 | United Kingdom . | |
| 916870 | 8/1959 | United Kingdom . | |
| 1100374 | 4/1965 | United Kingdom . | |
| 1558058 | 2/1978 | United Kingdom . | |
| 1588077 | 2/1978 | United Kingdom . | |
| 2081851 | 2/1982 | United Kingdom | 102/476 |

*Primary Examiner*—Charles T. Jordan
*Assistant Examiner*—Ted L. Parr
*Attorney, Agent, or Firm*—Pollack, Vande Sande & Priddy

[57] ABSTRACT

This invention relates to a hollow charge for a missile, projectile, shell or the like. The invention is particularly intended to be used on a missile which is arranged to pass a target and the hollow charge initiated when the missile is over, at the side of or under the target which means that the hollow charge is inclined with respect to the longitudinal axis (13) of the missile. The hollow charge comprises an inner, jet-forming, trumpet-shaped cone member (3) and an outer casing (2) having a substantially straight cylindrical part (8) connected to a conical tapered part (9, 10) to give the hollow charge jet an extremely high front tip velocity as well as a low velocity gradient.

5 Claims, 2 Drawing Figures

HOLLOW CHARGE

TECHNICAL FIELD

The invention relates in general to a hollow charge for a missile, projectile, shell or the like. The invention is particularly intended to be used in a missile or the like which is arranged to pass a target and where the hollow charge is inclined with respect to the longitudinal axis of the missile.

BACKGROUND ART

Due to recent developments of protective armour, for instance the use of composite armour, the importance of a great armour piercing capability has increased. Thus longer and heavier hollow charges have been designed. In certain cases this can be accepted, for example for multipurpose shells or the like; but for such system equipments which are strictly optimized with respect to weight and available space, for double and tandem charges or the like, this method is unsuitable. In practice with today's technology the length and weight of the charges is approaching a limit.

This is one of the reasons for the recent development of missiles, projectiles or the like which are intended to pass the target and in which the warhead is initiated when the missile is above, at the side of or under the target; so that, the damaging effect is concentrated on the least protected sections of the target. In order to achieve a damaging effect the warhead then must be inclined with respect to the longitudinal axis of the missile.

If the target is a battle tank, the most damaging effect is achieved if the missile passes at a certain distance above the tank and the warhead is inclined so that it hits the tank from above, that is, hits the roof of the tank which as a rule is the most vulnerable part of the tank.

As a consequence of the velocity difference between the passing missile and the target, specific requirements are made on the hollow charge, however, in order to ensure a sufficient damaging effect. It has thus been shown that a conventional hollow charge having an acceptable static penetration capability often gives an unsatisfactory dynamic penetration. The reason for this is supposed to be the so-called "pole-vault effect" which happens when the rear parts of the hollow charge jet are "bent over" the newly made hole in the armour of the target due to the movement of the missile and due to the fact that the velocity of the rear parts of the hollow charge jet is less than the velocity of the front parts of the jet.

To compensate for a reduced penetration capability by increasing the length and weight is, as already mentioned, often impossible due to the limited space available. This is particularly the case for an over-flying missile in which the hollow charge is inclined with respect to the longitudinal axis of the missile, as this even more decreases the space available for incorporating the charge in the missile body and specifically limits the length of the charge.

DISCLOSURE OF THE INVENTION

An object of the present invention is to provide a hollow charge of the above-mentioned type having an increased penetration capability, particularly an increased dynamic penetration capability, together with a compact size to permit the charge to be built in into a very limited space.

The hollow charge according to the invention is particularly characterized by an inner, jet-forming, trumpet shaped cone member and an outer casing having a substantially straight, cylindrical part connected to a cone shaped tapered part in order to give the generated hollow charge jet an extremely high front tip velocity as well as a low velocity gradient. This is because it has been proved that a high velocity of the front tip of the hollow charge jet in combination with a low velocity gradient results in a more continuous jet, that is, a late disintegration of the jet which increases the armour penetration capability of the jet. This also means that the dynamic penetration capability of the jet increases since approximately 80% of the penetrating energy relates to the high-velocity front parts of the jet while the low-velocity rear parts of the jet, which give rise to the "pole-vault effect", now are less important.

The unique charge geometry according to the invention permits a very compact design of the charge. A further significant feature of the invention is thus the fact that the ratio between the cone length and the total length of the charge is about 0.8.

BRIEF DESCRIPTION OF THE DRAWINGS

In the following the invention will be described more in detail with reference to the accompanying drawings illustrating a preferred embodiment of the invention.

BEST MODE FOR CARRYING OUT THE INVENTION

Figure 1:
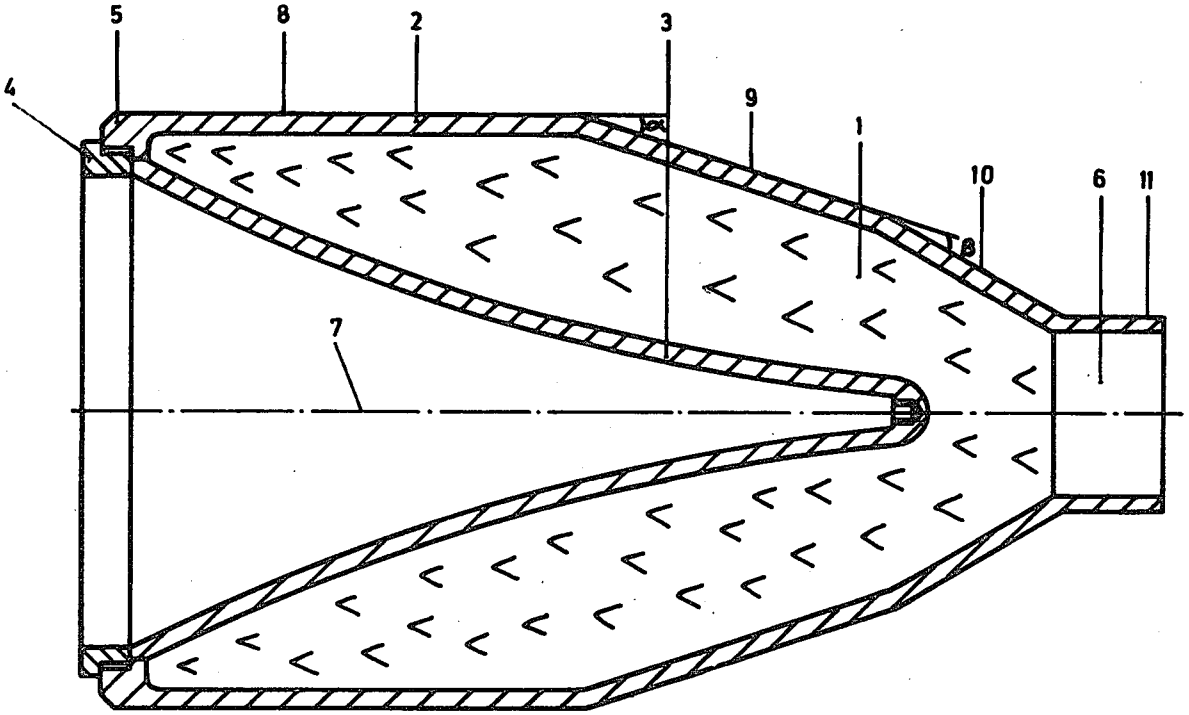
FIG. 1 shows the specific design of the hollow charge.

FIG. 1 shows a longitudinal section of a proposed hollow charge. As illustrated in the figure, the charge includes a space 1 filled with an explosive which is known by itself, for instance cast loaded octol. The space 1 is enclosed by an outer steel casing 2 and an inner copper cone 3 from which the hollow charge jet is generated when the explosive is initiated. The hollow charge cone 3 is kept in place by a ring 4 mounted at the end part of the casing 2, which is provided with a flange 5. The explosive 1 is ignited by a central detonator and ignition means (not shown). Such central initiation of the explosive is known by itself and will not be described in detail here. At the ignition an axial detonation wave front having a certain velocity of propagation is generated and a hollow charge jet is formed in the longitudinal direction 7 of the charge.

It has been shown that there are mainly four characteristics which determine the armour piercing capability of the hollow charge jet: (1) the velocity of the front tip of the jet, (2) the velocity gradient of the jet, (3) the disintegration distance and (4) the amount of metal in the jet. By "velocity gradient of the jet" we mean the velocity difference between the front tip of the jet and the rear parts of the jet expressed in m/s per meter. By "disintegration distance" we mean the distance between the base of the charge cone member and the place where the disintegration of the jet starts. This means that the disintegration distance is a measure of the continuous length of the jet. The front tip velocity of previously known conventional hollow charge cone members with straight generatrix is about 7000 m/s. Such velocities have then been reached by hollow charge cone members with a cone half angle of 25°. Such types of charges give a continuous jet length of approximately 6 calibres.

The hollow charge according to the present invention is characterized by an extremely high velocity of the front tip of the jet, preferably about 10000 m/s as well as a jet velocity gradient which is lower than previously.

As a general rule the velocity of the tip of the jet is increased with a decreasing angle. This means that the conventional way of increasing the tip velocity has been this decrease of the cone angle. The disadvantage of such solutions, however, is the fact that the charges will become longer and heavier. Instead of decreasing the cone angle in our invention a substantial increase of the front tip velocity has been reached by an optimized geometrical design of the charge. More particularly, in our invention a trumpet-shaped cone member has been used which has been shown to be more efficient with respect to its length compared with a corresponding straight cone member. By means of such a trumpet-shaped cone member, extremely high jet front tip velocities of about 10000 m/s have been reached. In this case the generatrix tangent angle of the cone member at the jet forming point is between 10° and 15°. As an example it can be mentioned that for a generatrix tangent angle of 13.5° at the jet forming point, the jet front tip velocity for such a trumpet cone member is 9800 m/s.

The outer casing 2 of the hollow charge is further provided with a substantially straight, cylindrical part 8 which is connected to a first conical, tapered part 9 which is connected to a second conical, tapered part 10. Straight cylindrical part 8 is connected to first tapered part 9 via a comparatively big angle $\alpha$, and first tapered part 9 is then connected to the second tapered part 10 via an angle $\beta$, smaller than the angle $\alpha$. Second tapered part 10 of the outer casing is further connected to a cylindrical part 11 enclosing the detonator 6.

This charge geometry provides a very compart design of the hollow charge. For instance the ratio between the length of the cone member and the total length of the charge is approximately 0.8.

Figure 2:
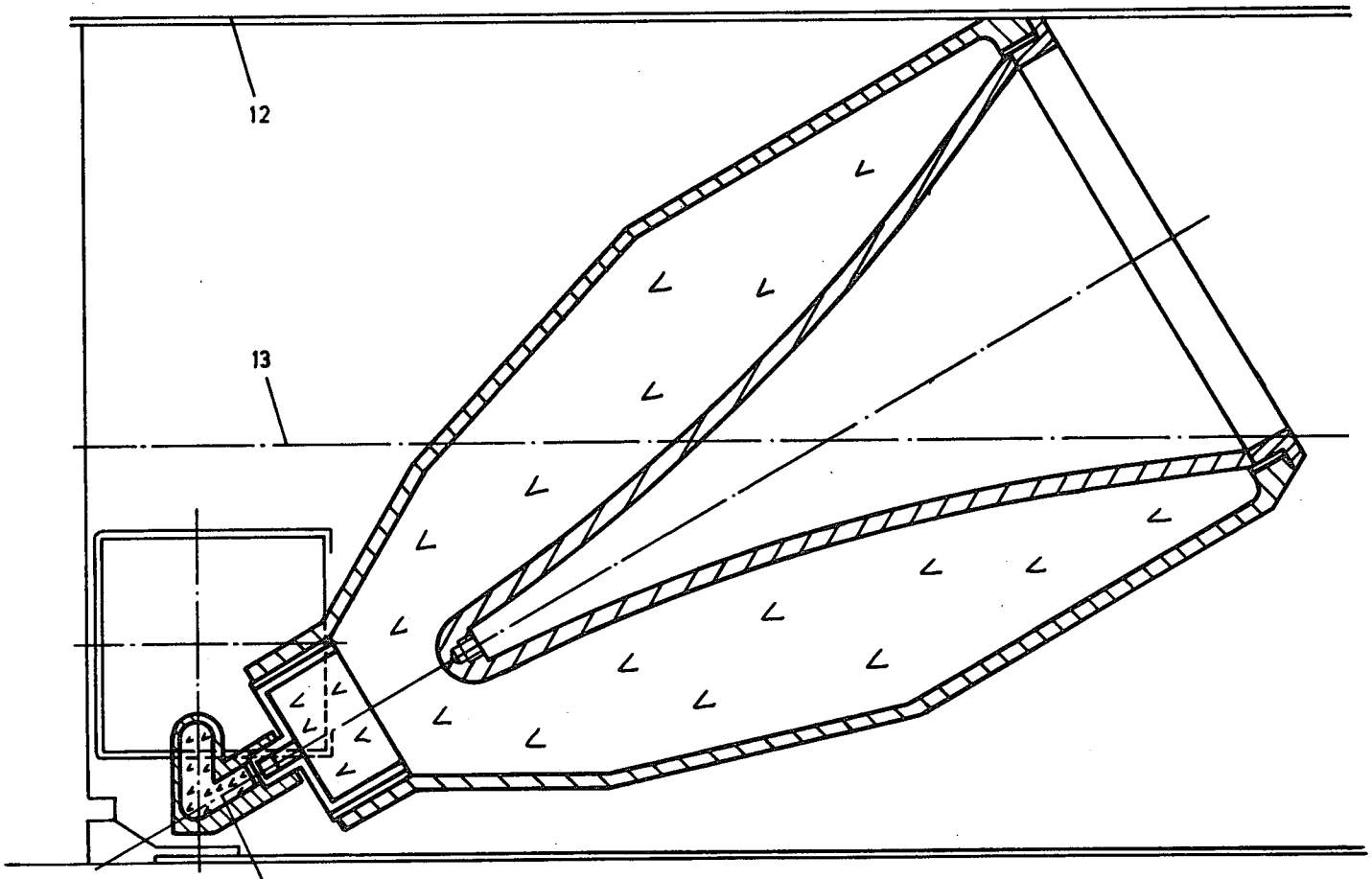
FIG. 2, the hollow charge disposed within the missile body.

FIG. 2 illustrates the hollow charge warhead arranged within the body of a missile, projectile, rocket, shell or the like which is to pass above a target. The warhead is inclined 30° with respect to the longitudinal axis 13 of the missile or the like. It has been proved that such an orientation is suitable for the most frequent target situations. As illustrated in the figure, the igniting means 14 has been bent in order to be housed within the missile body, but other than that the warhead is the same as in FIG. 1.

Experiments have shown that if the missile is passing above a target with a velocity of 200–300 m/s, then only those parts of the hollow charge jet whose velocity exceeds 6000 m/s have enough power for armour penetration, due to the fact that those parts of the hollow charge jet which have a lower velocity do not hit the same entrance hole. Even if the jet front tip velocity of conventional warheads is about 7000 m/s as already mentioned, the damaging effect of such warheads is unsatisfactory.

By increasing the jet front tip velocity to approximately 10000 m/s as well as decreasing the velocity gradient, the amount of copper is increased within the velocity interval of 10000 m/s–6000 m/s. As a matter of fact this means that about 80% of the penetration capability is stored within the front parts of the jet which have velocities between 10000 and 6000 m/s. Only 20% of the penetration capability is stored within the rear parts of the jet, which parts have velocities between 6000 and 2000 m/s and which velocities are too small for armour penetration.

We claim:

1. A hollow charge for a missile, projectile, shell or the like, comprising:

a charge body of explosive material, said charge body having a total length;

an inner jet-forming trumpet-shaped cone member formed within and opening outwardly at one end of said charge body, said trumpet-shaped cone member having a length and a generatrix tangent angle in the range of 10 degrees to 15 degrees; and an outer casing enclosing said charge body, said casing having a substantially straight cylindrical part extending along said charge body from said one end, said cylindrical part being connected to a conical, tapered part extending further along said charge body, the ratio between said length of said trumpet-shaped cone member and said total length of said charge body being approximately 0.8:1;

whereby a hollow charge jet generated on ignition of said charge body has a front tip velocity of approximately 10000 m/s and a velocity gradient lower than would be obtained by a straight cone member.

2. A charge according to claim 1, wherein said substantially straight cylindrical part of said outer casing is connected to a first conical tapered part making an angle $\alpha$ to said substantially straight cylindrical part, and said first conical tapered part is connected to second conical tapered part which makes an angle $\beta$ to said first conical tapered part, angle $\beta$ being smaller than angle $\alpha$.

3. An ammunition unit, comprising:

a hollow body;

a charge body of explosive material positioned within said hollow body, said charge body having a total length;

an inner jet-forming trumpet-shaped cone member formed within and opening outwardly at one end of said charge body, said trumpet-shaped cone member having a length and a generatrix tangent angle in the range of 10 degrees to 15 degrees; and an outer casing enclosing said charge body, said casing having a substantially straight cylindrical part extending along said charge body from said one end, said cylindrical part being connected to a conical, tapered part extending further along said charge body, the ratio between said length of said trumpet-shaped cone member and said total length of said charge body being approximately 0.8:1;

whereby a hollow charge jet generated on ignition of said charge body has a front tip velocity of approximately 10000 m/s and a velocity gradient lower than would be obtained by a straight cone member.

4. An ammunition unit according to claim 3, wherein said substantially straight cylindrical part of said outer casing is connected to a first conical tapered part making an angle $\alpha$ to said substantially straight cylindrical part, and said first conical tapered part is connected to a second conical tapered part which makes an angle $\beta$ to said first conical tapered part, angle $\beta$ being smaller than angle $\alpha$.

5. An ammunition unit according to claim 3, wherein said hollow charge is inclined with respect to the longitudinal axis of the unit.

* * * * *